US006981932B1

(12) United States Patent
Huang et al.

(10) Patent No.: US 6,981,932 B1
(45) Date of Patent: Jan. 3, 2006

(54) ROWING MACHINE

(75) Inventors: Chin-Lien Huang, Taoyuan Hsien (TW); Johnson Kuo, 5F., No. 6, Lane 12, Sec. 6, Hsin I Rd., Taipei (TW)

(73) Assignee: Johnson Kuo, Taipei (TW)

( * ) Notice: Subject to any disclaimer, the term of this patent is extended or adjusted under 35 U.S.C. 154(b) by 273 days.

(21) Appl. No.: 10/658,423

(22) Filed: Sep. 10, 2003

(51) Int. Cl.
*A63B 69/06* (2006.01)
*A63B 21/02* (2006.01)

(52) U.S. Cl. ..... 482/72; 482/121

(58) Field of Classification Search ..... 482/72, 482/95–96, 114–116, 121–126, 135–136, 482/142
See application file for complete search history.

(56) References Cited

U.S. PATENT DOCUMENTS 4,884,802 A * 12/1989 Graham ..... 482/130
5,042,797 A * 8/1991 Graham ..... 482/96
5,334,120 A * 8/1994 Rasmussen ..... 482/97
5,549,529 A * 8/1996 Rasmussen ..... 482/96
5,899,836 A * 5/1999 Chen ..... 482/92
5,906,564 A * 5/1999 Jacobsen ..... 482/96
5,913,752 A * 6/1999 Bolf ..... 482/72
5,967,955 A * 10/1999 Westfall et al. ..... 482/142
6,071,217 A * 6/2000 Barnett ..... 482/121
6,634,996 B2 * 10/2003 Jacobsen ..... 482/96
6,817,968 B2 * 11/2004 Galbraith et al. ..... 482/72

* cited by examiner

*Primary Examiner*—Stephen R. Crow
*Assistant Examiner*—Fenn C. Mathew
(74) *Attorney, Agent, or Firm*—Troxell Law Office, PLLC

(57) ABSTRACT

A rowing machine is constructed to include a sloping angle-adjustable base frame, a foot rack selectively and pivotally mounted on the base frame at the front side, a rocker arm coupled with a detachable handlebar for rowing exercise to stretch elastic cord members, a slide slidably mounted on two parallel rails of the base frame to support a seat and a collapsible back, and two elastic pull cords detachably fastened to the base frame for pulling by the user sitting on the seat.

3 Claims, 11 Drawing Sheets

ROWING MACHINE

BACKGROUND AND SUMMARY OF THE INVENTION

The present invention relates to exercising machines and, more particularly, to a rowing machine, which is collapsible and, practical for exercising the muscles of different parts of the body.

FIG. 1 shows a rowing machine according to the prior art. This rowing machine is practical for exercising rowing action. However, this design of rowing machine is not adjustable subject to the user's body size. Furthermore, this design of rowing machine requires much storage space because it is not collapsible when not in use.

The present invention has been accomplished under the circumstances in view. According to one aspect of the present invention, the user can apply force to the handlebar to turn the rocker arm back and forth and to further stretch the elastic cord members, and at the same time apply force the to seat with the legs and the hips to move the slide along the rails and to further stretch the elastic cord members, i.e., simulate rowing action to exercise the muscles of the waist, abdomen, legs, and hands. The user can also selectively exercise the hands or the legs only, or connect the elastic pull cords to the eyes at the horizontal front foot bar or the eyes at the horizontal rear foot bar and then pull the handles when moving the slide along the rails.

According to another aspect of the present invention, the rowing machine is collapsible. The foot rack can directly be turned inwards and closely attached to the rails of the base frame. Thereafter, the rocker arm and the seat can be received to the base frame, and then the rear support can be received to the bottom side of the rails of the base frame. The handlebar can further be detached from the rocker arm to reduce the packing size.

According to still another aspect of the present invention, the combined height of the vertical front bars and horizontal front foot bar of the base frame is lower than the combined height of horizontal rear foot bar and hollow upright sleeve of the rear support so that the rails are supported sloping forwardly downwards. Therefore, less resisting force is produced upon forward stroke of the slide, and much resisting force is produced upon back stroke of the slide.

According to still another aspect of the present invention the spring pin of the upright sleeve can be shifted from one locating hole to another to lock the sliding bar to the upright sleeve in one of a series of elevational positions, adjusting the rails to the desired sloping angle.

According to still another aspect of the present invention, the stop rod can selectively e fastened to the locating holes of the top lugs to limit the turning angle of the rocker arm subject to the user's body size (waistline).

DETAILED DESCRIPTION OF THE INVENTION

Figure 1:
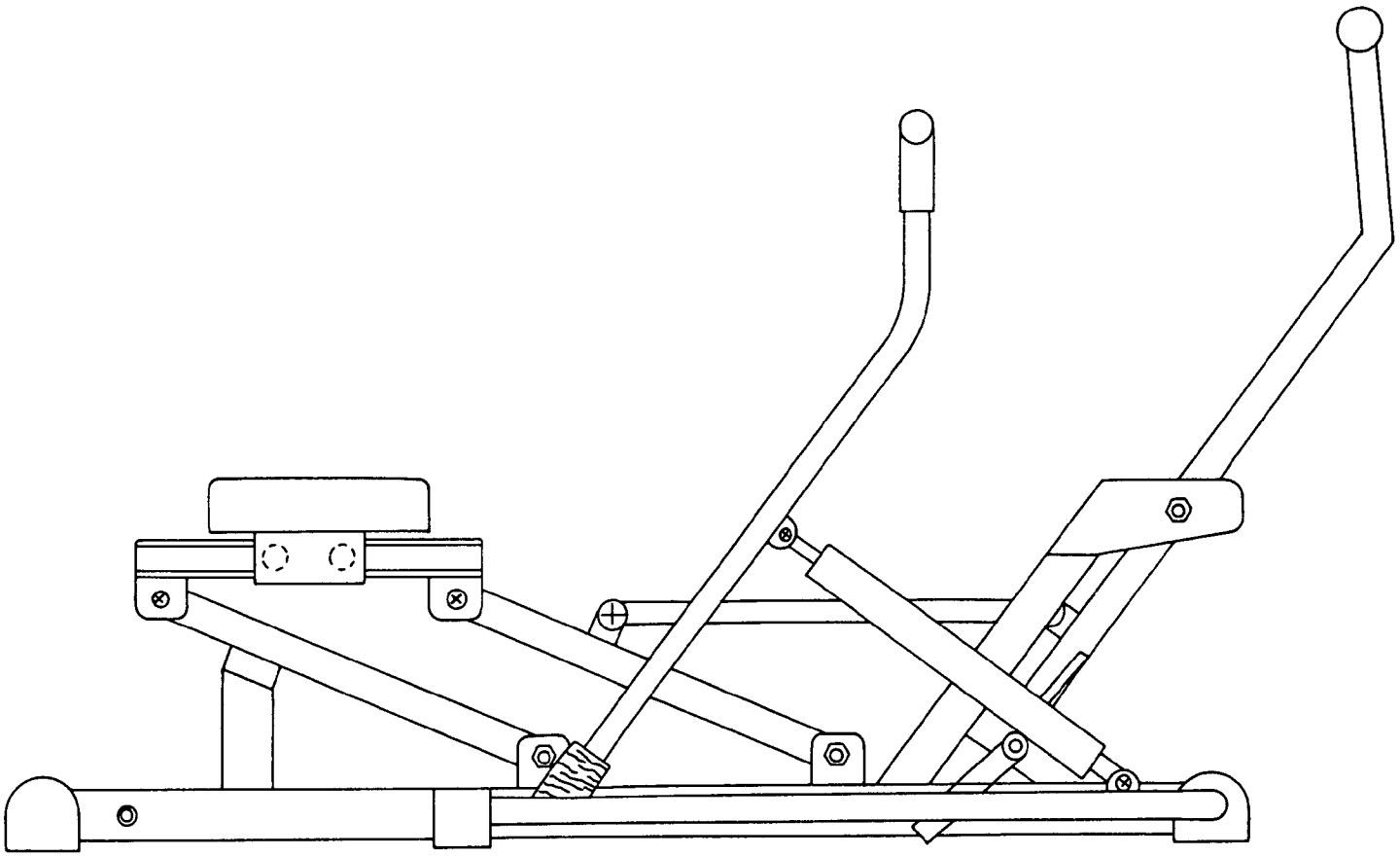
Fig. 1 PRIOR ART
FIG. 1 is a side plain view of a rowing machine according to the prior art.

Referring to FIGS. 2~11, a rowing machine in accordance with the present invention is shown comprised of a base frame 1, a foot rack 2, a rear support 3, a rocker arm 4, a handlebar 5, a slide 6, a seat 71, and a back 72.

The base frame 1 comprises two parallel rails 11 arranged in parallel, the rails 11 each having a plurality of locating grooves 1113 spaced near the front end for the positioning of the front foot rack 2 and a pin hole 1111 disposed near the rear end, each locating groove 1113 having a top entrance 1114 and an inner stop portion 1115, a horizontal front foot bar 112 transversely disposed at the front side below the rails 11, two vertical front bars 111 vertically connected between the front ends of the rails 11 and the horizontal front foot bar 112, a stop bar 1110 transversely connected between the front legs 111 and spaced between the rails 11 and the horizontal front foot bar 112, two rollers 1122 fastened pivotally with the horizontal front foot bar 112 near the two ends, two eyes 1121 fixedly provided at the horizontal front foot bar 112 near the two ends, two elastic pull cords 81, the elastic pull cords 81 each having a swivel hook 811 provided at one end and respectively coupled to the eyes 1121 and a handle 812 provided at the other end, two bottom lugs 15 symmetrically provided at the bottom side of the rails 11 near the front legs 111, two elastic cord members 16 each having a first end 161 respectively fastened to the lugs 15 and a second end 162 respectively connected to the slide 6, two top lugs 119 respectively fixedly located on the rails 11 near the middle, the top lugs 119 each having a plurality of locating holes 1191 and 1192, and a stop rod 17 selectively fastened to the locating holes 1191 and 1192 of the top lugs 119 and adapted to limit the turning angle of the rocker arm 4.

The foot rack 2 comprises a bottom block 21 inserted in between the rails 11, two coupling rods 212 (see FIG. 6) bilaterally extended from the bottom block 21 and selectively pivotally coupled to the locating grooves 1113 of the rails 11, a locating plate 22 provided at the top side of the bottom block 21 and supported on the rails 11, a supporting bar 221 obliquely upwardly extended from the locating plate 22, and a foot board 23 fixedly mounted on the supporting bar 221.

The rear support 3 comprises a horizontal rear foot bar 38 transversely disposed at the bottom, two eyes 381 fixedly provided at the horizontal rear foot bar 112 near the two ends for the connection of the swivel hooks 811 of the elastic pull cords 81 after disconnection of the elastic pull cords 81 from the eyes 1121 at the horizontal front foot bar 112, a hollow upright sleeve 31 vertically upwardly extended from the middle part of the horizontal rear foot bar 38, two lugs 36 fixedly provided at two sides of the upright sleeve 31, a sliding bar 32 slidably inserted into the upright sleeve 31, the sliding bar 32 having a plurality of transversely extended locating holes 321 arranged at different elevations and a top end pivotally connected between the rear ends of the rails 11 by a pivot 12, a grip 120 fixedly connected to one end of the pivot 12 for the holding of the user's hand when receiving the rowing machine, a lock pin 30 fastened to the pin holes 1111 of the rails 11 to lock the sliding bar 32 to the rails 11 (see FIG. 7), a spring pin 311 provided at the upright sleeve 31 and selectively engaged into one locating hole 321 to lock the sliding bar 32 to the upright sleeve 31 at the desired elevation (see FIG. 9), a locating plate 34 fixedly fastened to the rails 11 at the rear side by screws 113, and an adjustment knob 35 mounted in the locating plate 34 and adapted to adjust the angular position of the rear support 3 relative to the rails 11. The adjustment knob 35 has a threaded shank 351 threaded into the top side of the sliding bar 32 (see FIG. 7). Further, the locating plate 34 has a spare screw hole 340 adapted to accommodate the adjustment knob 35 after disconnection of the adjustment knob 35 from the locating plate 34 and the sliding bar 32 when collapsing the rowing machine.

The rocker arm 4 is a tubular arm having a middle arm portion 41, which has a front side 411 supported on the stop rod 17, a front arm portion 42 obliquely forwardly extended from one end, namely, the top end of the middle arm portion 41, and a rear arm portion 43 obliquely backwardly extended from the other end, namely, the bottom end of the middle portion 41. Two connecting plates 44 are bilaterally pivotally fastened to the end of the rear arm portion 43 with a pivot 431. Elastic cord members 45 are provided having the respective first ends 451 respectively connected to the connecting plates 44 and the respective second ends 452 respectively connected to the lugs 36 at the upright sleeve 31.

The handlebar 5 comprises is a T-bar having a vertically extended bottom mounting portion 51 and two substantially transversely extended top hand grips 52. The vertically extended bottom mounting portion 51 is inserted into the front arm portion 42 of the rocker arm 4, having a plurality of locating holes 511 longitudinally arranged in a row. A spring pin 421 is provided at the front arm portion 42 and selectively engaged into one locating hole 511 to lock the handlebar 5 to the rocker arm 4 (see FIG. 4). Further, a meter 50 is provided on the middle of the handlebar 5 at the top (see FIG. 2).

Figure 3:
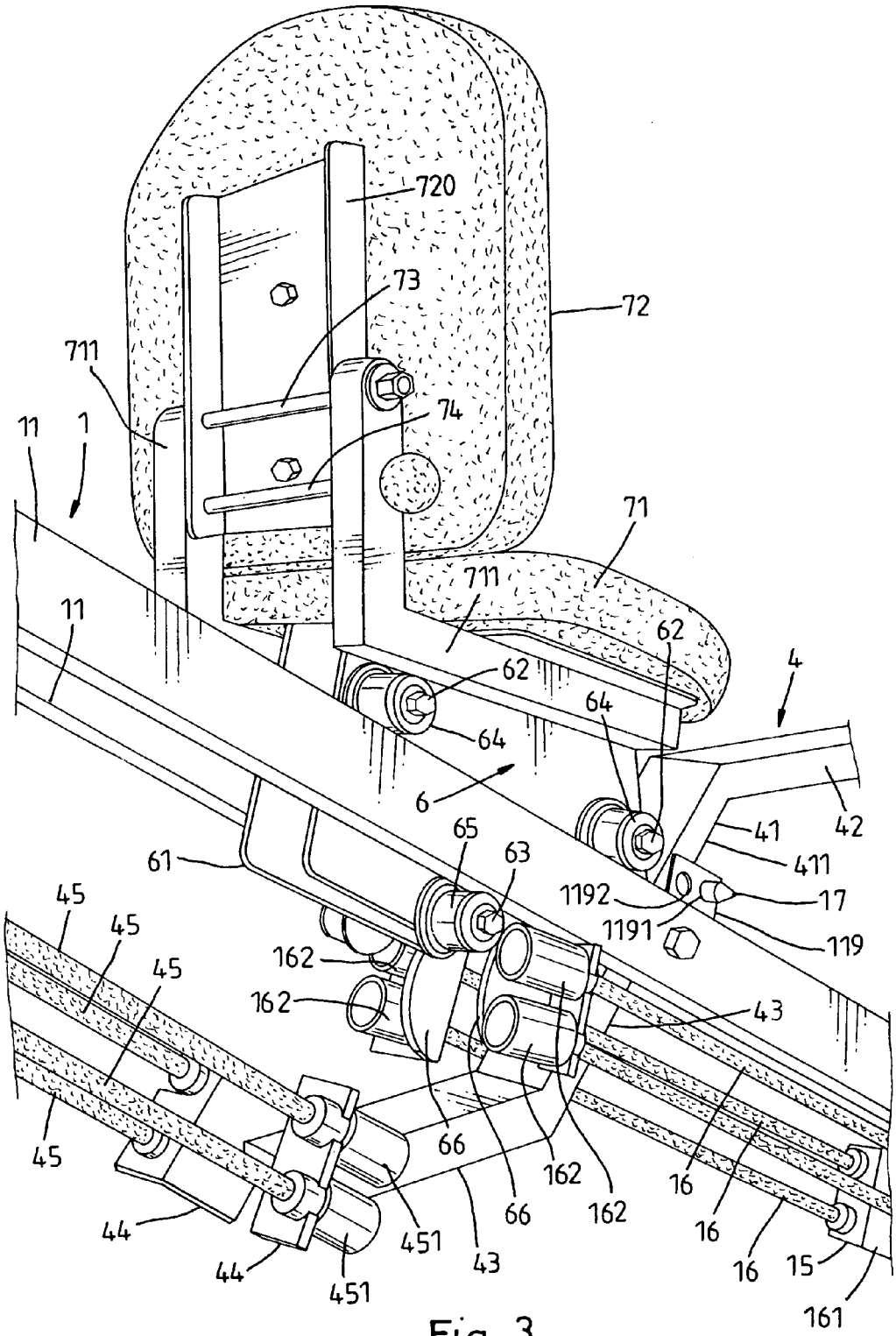
FIG. 3 is an elevational view in an enlarged scale of a part of the rowing machine according to the present invention.
Figure 4:
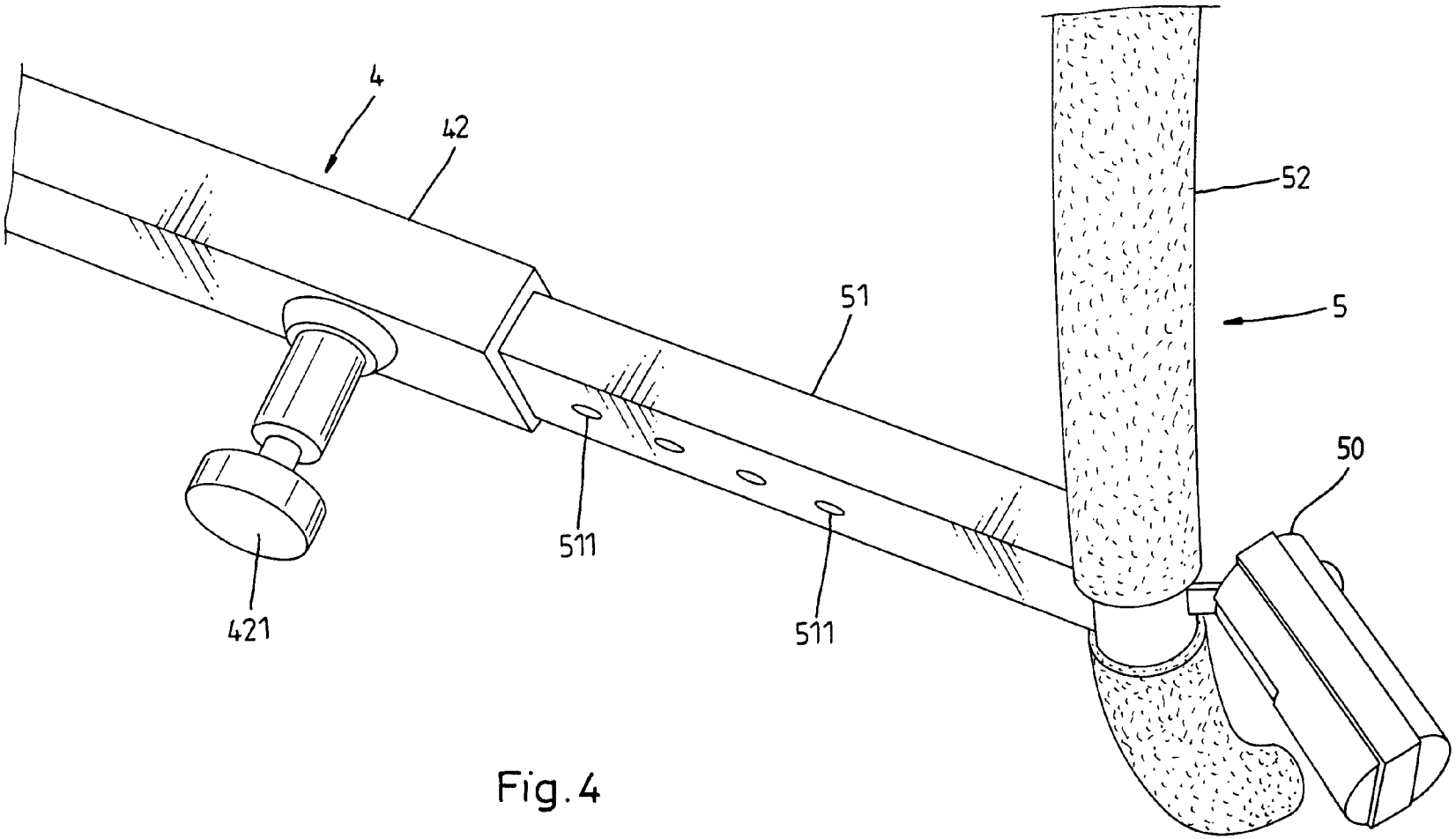
FIG. 4 is an elevational view in an enlarged scale of a part of the rowing machine showing the connection between the rocker arm and the handlebar. According to the present invention.
Figure 5:
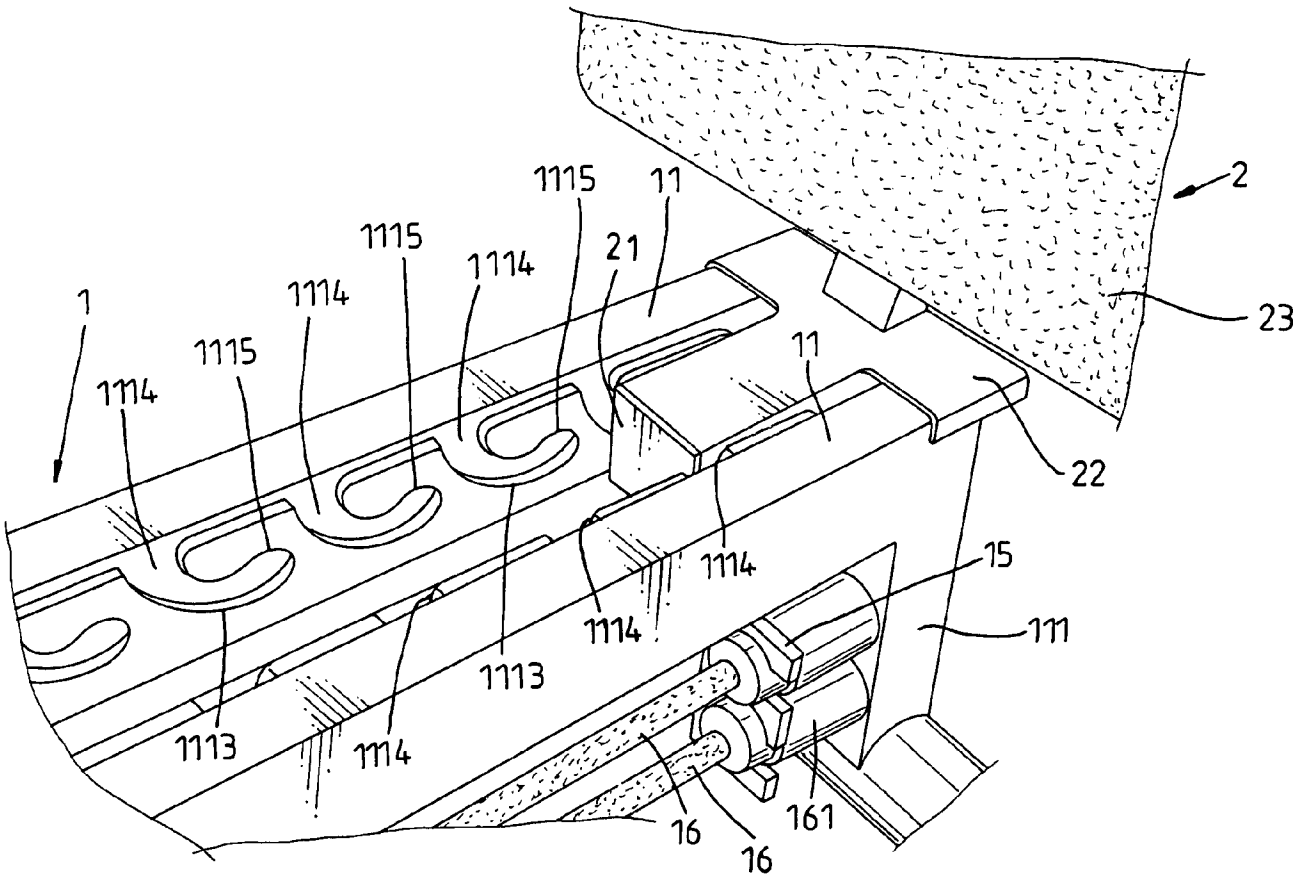
FIG. 5 is an elevational view in an enlarged scale of a part of the rowing machine showing the connection between the foot rack and the rails according to the present invention.
Figure 6:
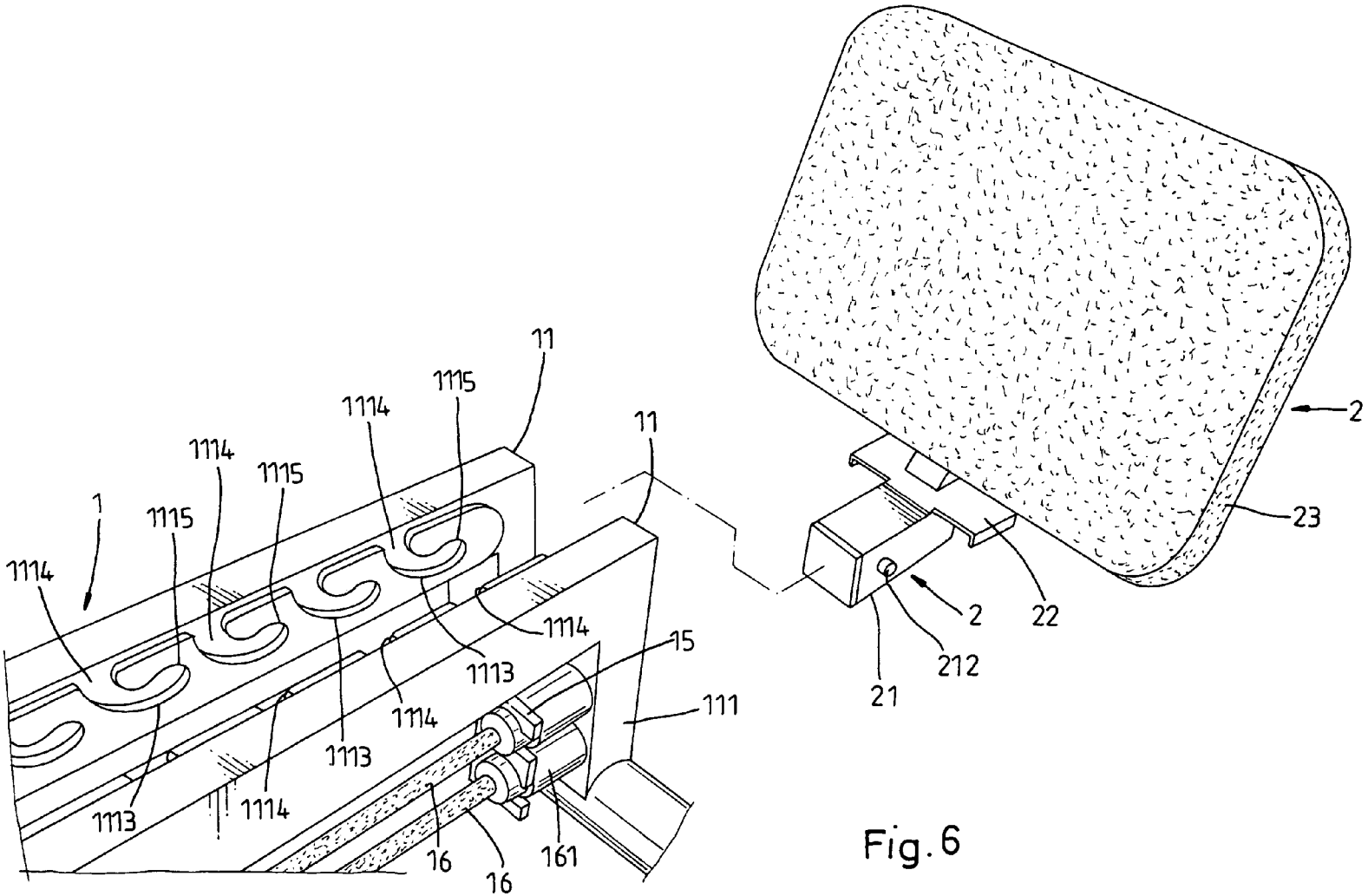
FIG. 6 is an exploded view in an enlarged scale of a part of the rowing machine, showing the relationship between the foot rack and the rails according to the present invention.
Figure 7:
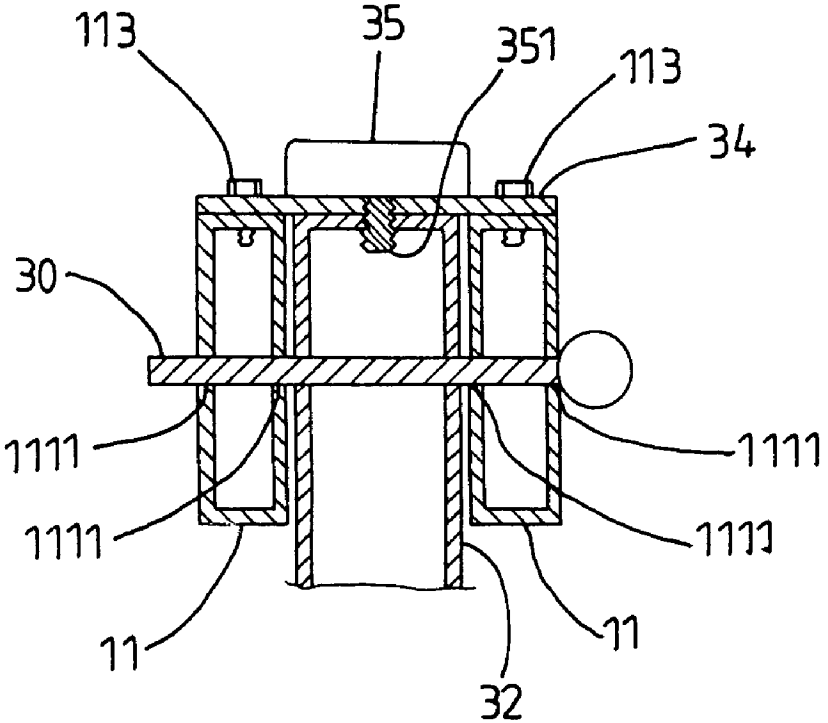
FIG. 7 is a sectional view in an enlarged scale of the rowing machine showing the connection between the rear part of the rails and the top part of the rear support according to the present invention.
Figure 8:
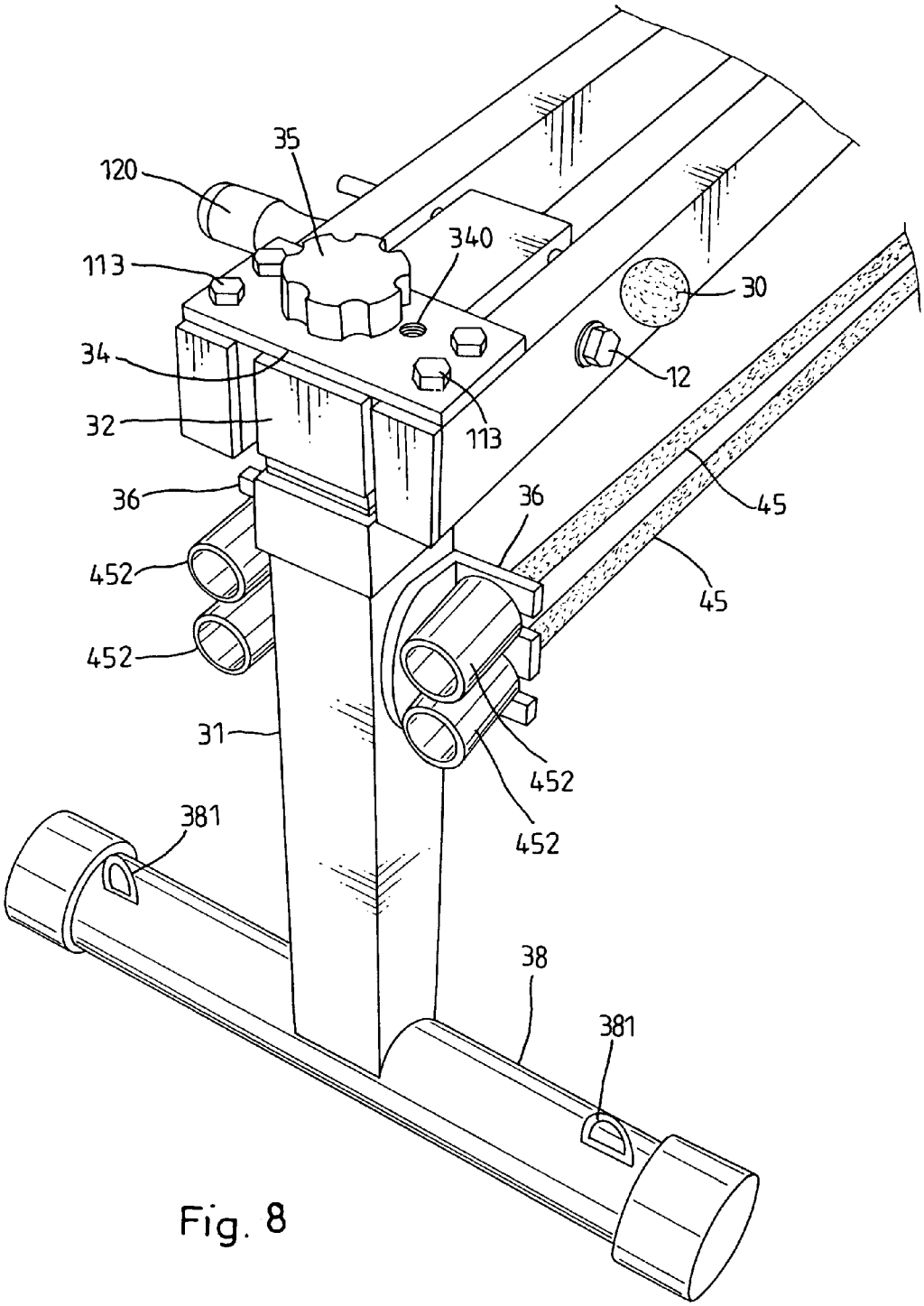
FIG. 8 is an oblique top view in an enlarged scale of the rear part of the rowing machine according to the present invention.
Figure 9:
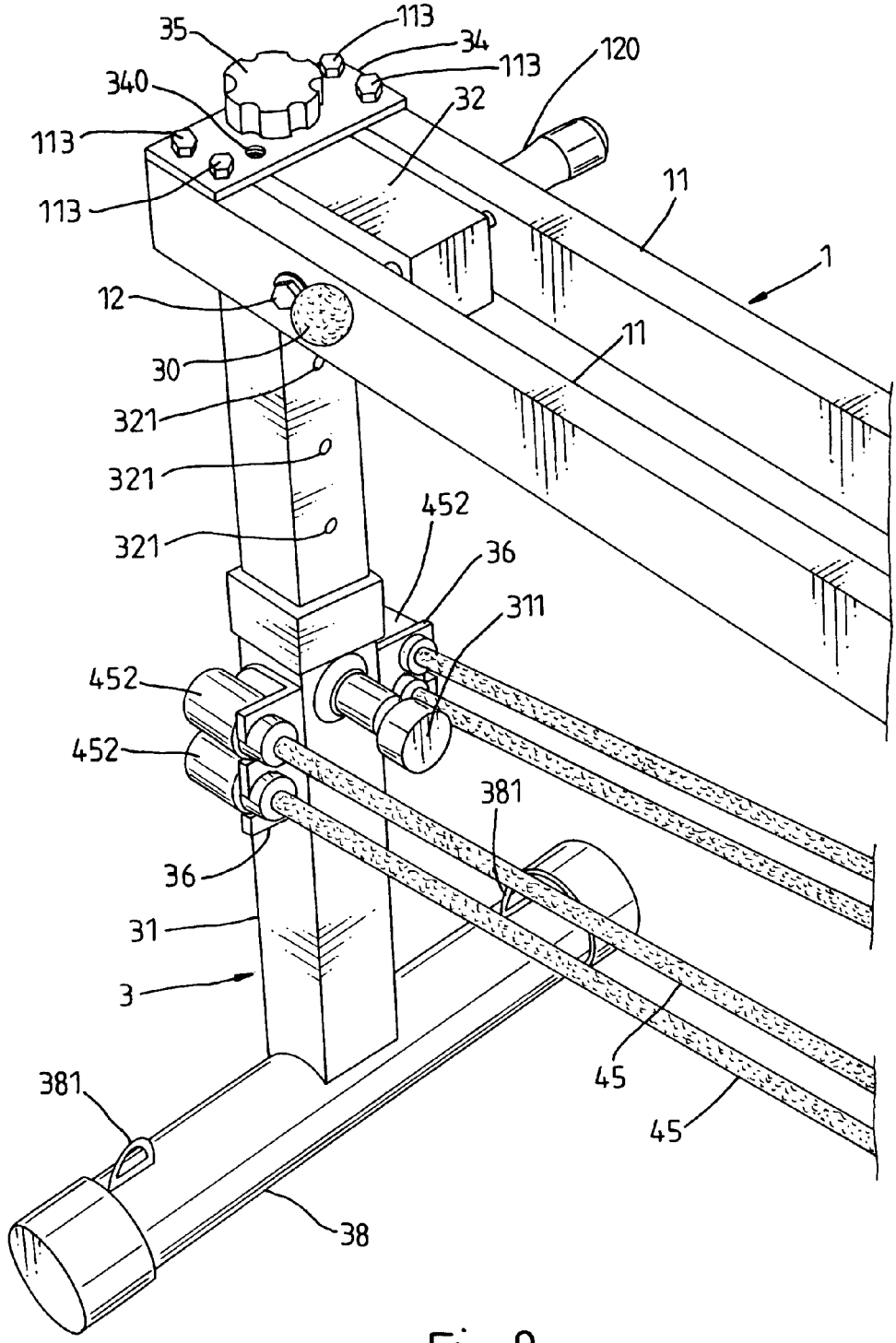
FIG. 9 is an oblique elevation of the rear part of the rowing machine according to the present invention.
Figure 10:
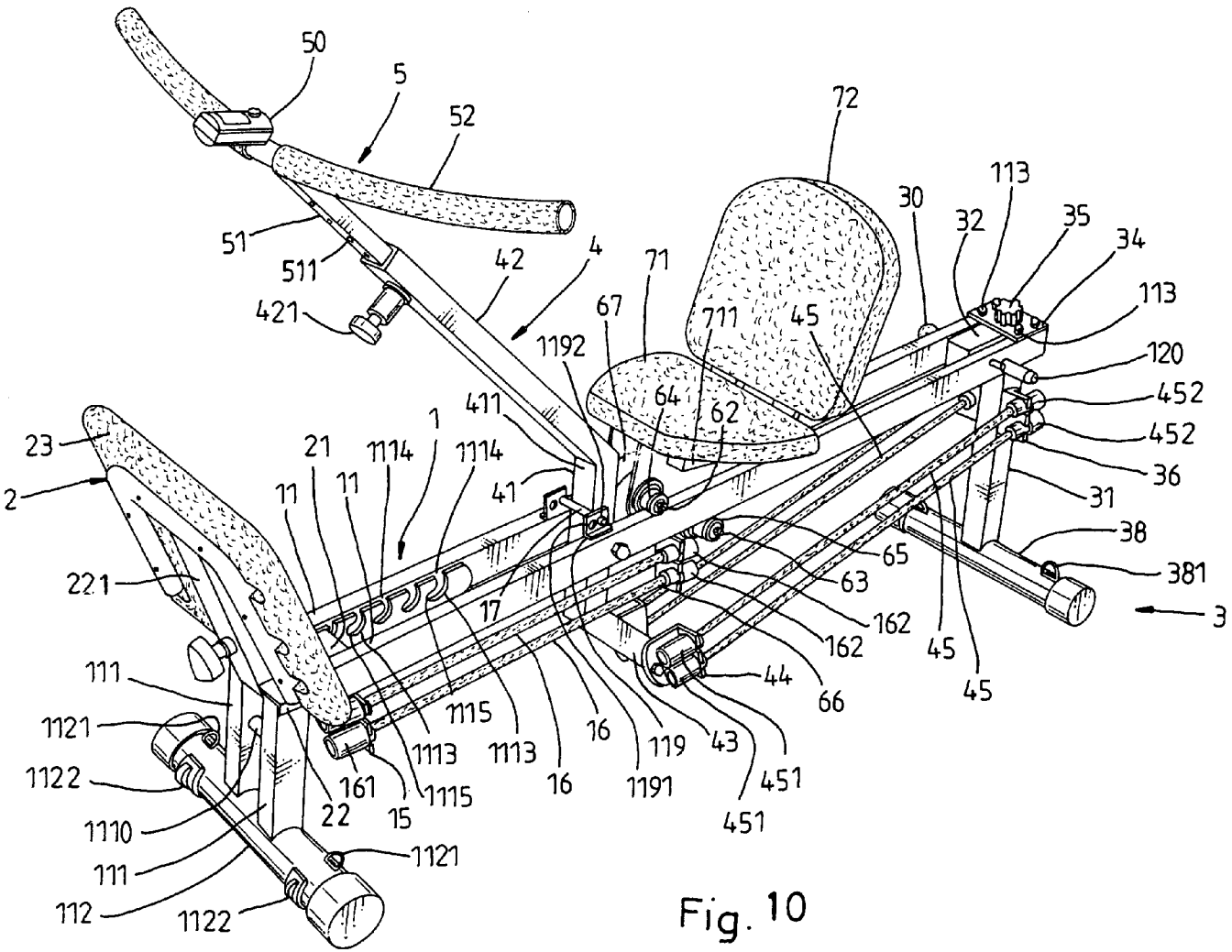
FIG. 10 is similar to FIG. 2 but showing the position of the stop rod adjusted.

The slide 6 comprises a substantially U-shaped base 61 inserted in between the rails 11, top and bottom wheel axles 62 and 63 provided at two sides of the base 61, top and bottom rollers 64 and 65 respectively mounted on the wheel axles 62 and 63 and peripherally disposed in contact with the rails 11 at top and bottom sides for enabling the base 61 to be moved along the rails 11, and two bottom lugs 66 bilaterally disposed at the bottom side of the base 61 for the connection of the second ends 162 of the elastic cord members 16 (see FIG. 3).

The seat 71 comprises a seat frame 711 fixedly fastened to the top side of the base 61 of the slide 6 (see FIG. 3).

The back 72 comprises a mounting frame 720 pivotally connected to the seat frame 711 of the seat 71 with a pivot pin 73. A lock pin 74 is detachably fastened to the seat frame 711 and the mounting frame 720 to lock the back 72 to the seat 71.

When in use, the user can sit on the seat 71 and rest the back on the back 72 with the feet stepped on the upper part of the foot board 23 and the hands holding the hand grips 52 of the handlebar 5, and then alternatively push and pull the hands and the legs, causing the rocker arm 4 to be alternatively turned forwards and backwards to alternatively stretch and release the elastic cord members 45. At the same time, the slide 6 is alternatively moved with the seat 71 and the user's hips back and forth along the rails 11 to alternatively stretch and release the elastic cord members 16. Therefore, the muscles of the user's abdomen, waist, legs, and hands are exercised. The user can also sit on the seat 71 and step the feet on the foot board 23 with the hands holding the seat 71, and then alternatively extend and receive the legs to move the slide 6 back and forth along the rails 11. The user can also sit on the seat 71 and step the feet on the foot board 23, and then alternatively stretch and release the elastic pull cords 81, which may be fastened to the eyes 1121 at the horizontal front foot bar 112 or the eyes 381 at the horizontal rear foot bar 38.

Figure 11:
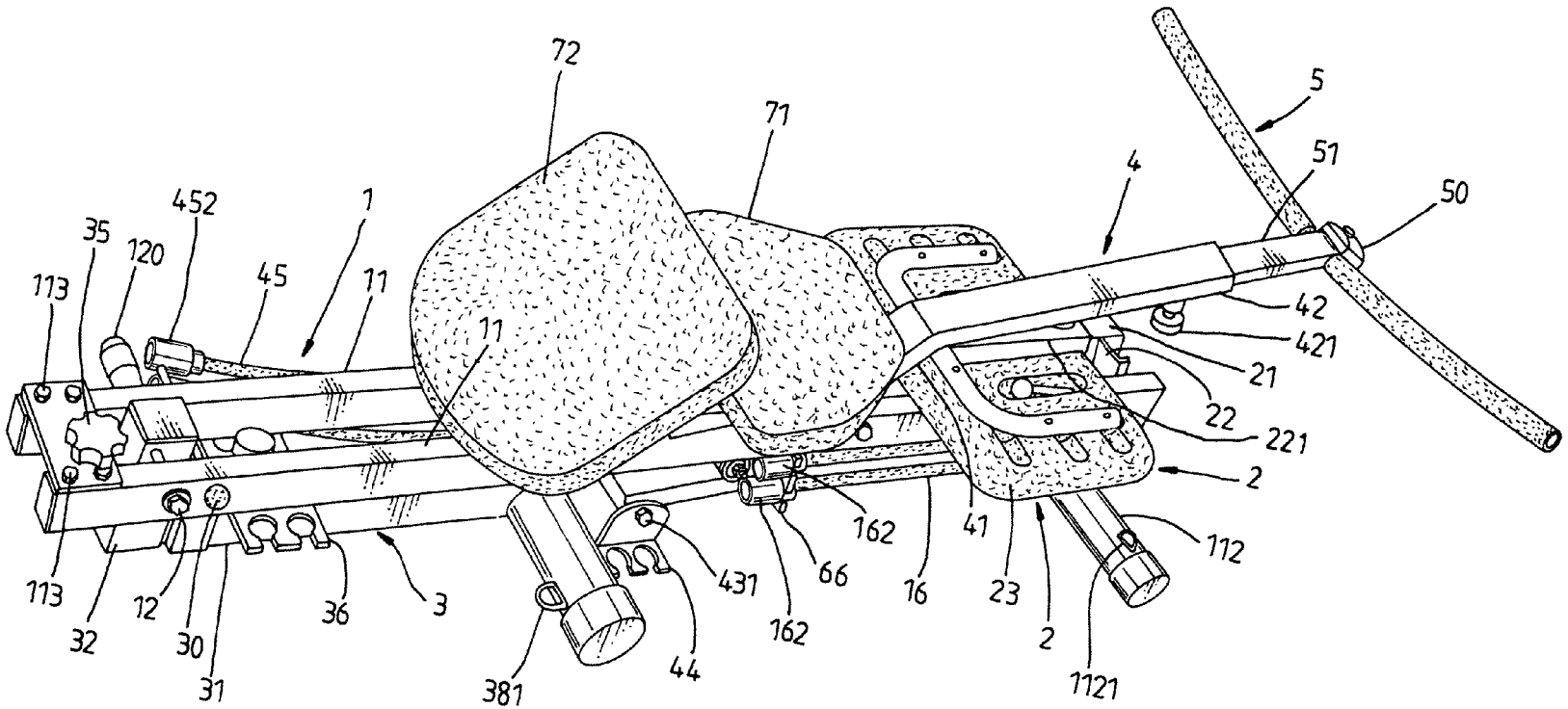
FIG. 11 shows the rowing machine received in a collapsed status according to the present invention.

When not in use, the user can lift the handlebar 5, and then turn the foot rack 2 downwardly inwards to be closely attached to the top side of the rails 11, and then remove the stop rod 17 from the top lugs 119 for enabling the rocker arm 4 to be turned in one direction and closely attached to the collapsed foot rack 2, and then the lock pin 74 is removed from the seat frame 711 and the mounting frame 720 to unlock the back 72, for enabling the back 72 to be turned in one directly and closely attached to the rails 11, and then remove the lock pin 30 from the pin holes 1111 of the rails 11 and the sliding bar 32 and also remove the adjustment knob 35 from the locating plate 34, for enabling the rear support 3 to be turned in one direction relative to the base frame 1 and closely attached to the rails 11 at the bottom side, and therefore the rowing machine is collapsed (see FIG. 11). If desired, the handlebar 5 can be detached from the rocker arm 4 and then put in a transverse direction to minimize packing or delivery space.

Further, the combined height of the vertical front bars 111 and horizontal front foot bar 112 of the base frame 1 is lower than the combined height of the horizontal rear foot bar 38 and hollow upright sleeve 31 of the rear support 3 so that the rails 11 are supported sloping forwardly downwards. Thus, the user can move the slide 6 forwards with less effort, and must employ much effort when moving the slide 6 backwards.

Figure 2:
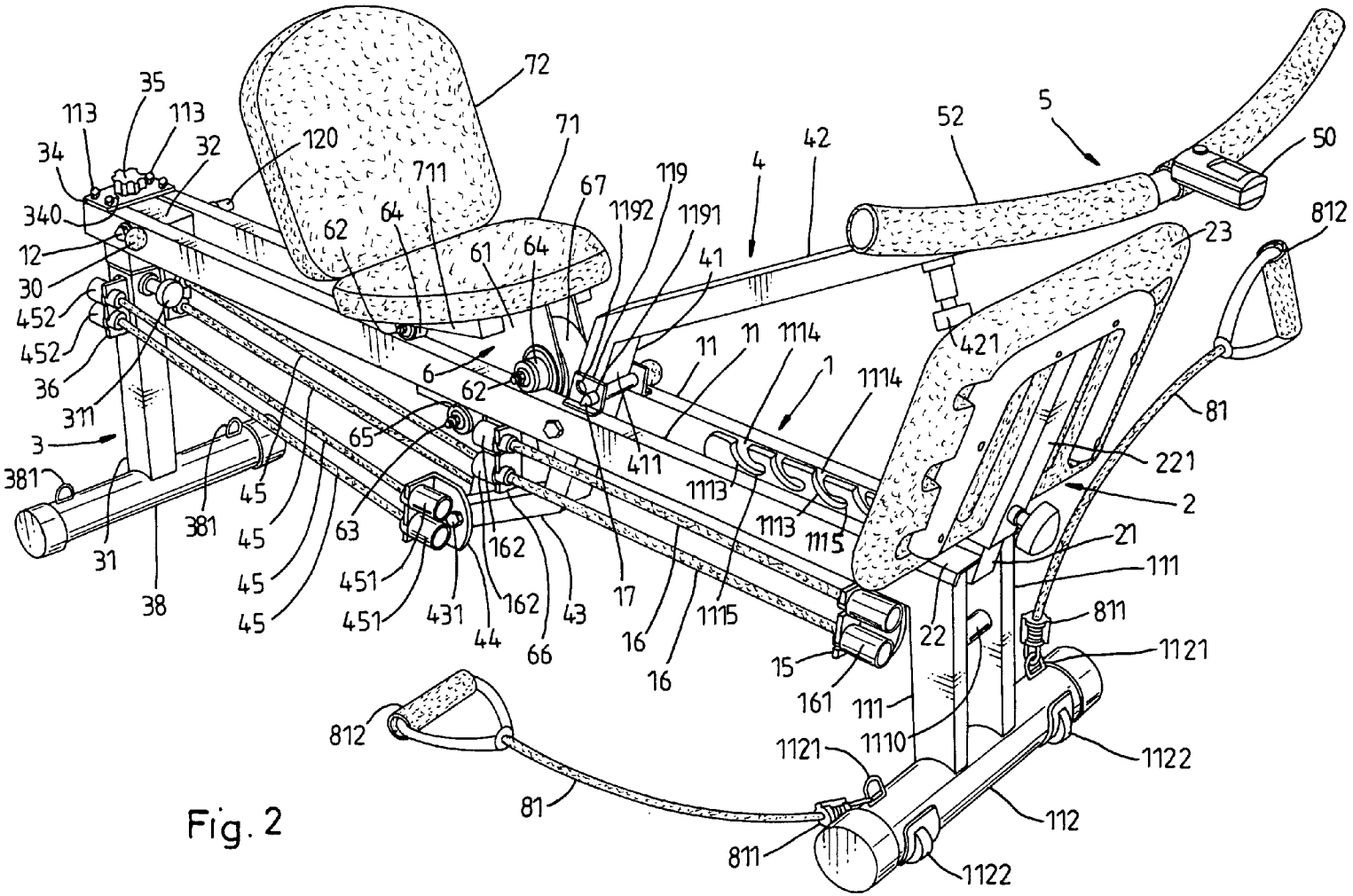
FIG. 2 is a perspective view of a rowing machine according to the present invention.

Further, a buffer wheel 67 is pivotally mounted in the U-shaped base frame 61 of the slide 6 and peripherally disposed in contact with the back side of the middle arm portion 41 of the rocker arm 4 (see FIG. 2).

As indicated above, the invention provides the following advantages and features:

1. The user can apply force to the handlebar 5 to turn the rocker arm 4 back and forth and to further stretch the elastic cord members 45, and at the same time apply force the to seat 71 with the legs and the hips to move the slide 6 along the rails 11 and to further stretch the elastic cord members 16, i.e., simulate rowing action to exercise the muscles of the waist, abdomen, legs, and hands. The user can also selectively exercise the hands or the legs only, or connect the elastic pull cords 81 to the eyes 1121 at the horizontal front foot bar 112 or the eyes 381 at the horizontal rear foot bar 38 and then pull the handles 812 when moving the slide 6 along the rails 11.

2. The rowing machine is collapsible. The foot rack 2 can directly be turned inwards and closely attached to the rails of the base frame 1. Thereafter, the rocker arm 4 and the seat 71 can be received to the base frame 1, and then the rear support 3 can be received to the bottom side of the rails of the base frame 1. The handlebar 5 can further be detached from the rocker arm 4 to reduce the packing size.

3. The combined height of the vertical front bars 111 and horizontal front foot bar 112 of the base frame 1 is lower than the combined height of horizontal rear foot bar 38 and hollow upright sleeve 31 of the rear support 3 so that the rails 11 are supported sloping forwardly downwards. Therefore, less resisting force is produced upon forward stroke of the slide 6, and much resisting force is produced upon back stroke of the slide 6.

4. The spring pin 311 of the upright sleeve 31 can be shifted from one locating hole 321 to another to lock the sliding bar 32 to the upright sleeve 31 in one of a series of elevational positions, adjusting the rails 11 to the desired sloping angle.

5. The stop rod 17 can selectively e fastened to the locating holes 1191 and 1192 of the top lugs 119 to limit the turning angle of the rocker arm 4 subject to the user's body size (waistline).

What is claimed is:

1. A rowing machine comprising:

a base frame, said base frame comprising two parallel rails arranged in parallel, said rails each having a front end, a rear end, a plurality of locating grooves spaced near the front end and a pin hole disposed near the rear end, said locating grooves each having a top entrance and an inner stop portion, a horizontal front foot bar transversely disposed at a front side below the front ends of said rails, two vertical front bars vertically connected between the front ends of said rails and said horizontal front foot bar, a stop bar transversely connected between said front legs and spaced between said rails and said horizontal front foot bar, two wheel fastened pivotally with said horizontal front foot bar near two ends of said horizontal front foot bar, two eyes fixedly provided at said horizontal front foot bar near two ends of said horizontal front bar, two bottom lugs symmetrically provided at a bottom side of said rails near said front legs, two top lugs symmetrically provided at a top side of said rails near a middle part of said rails, said top lugs each having a plurality of locating holes disposed at different elevations, and a stop rod selectively fastened to the locating holes of said top lugs;

a foot rack, said foot rack comprising a bottom block inserted in between said rails, two coupling rods bilaterally extended from said bottom block and selectively pivotally coupled to the locating grooves of said rails, a locating plate provided at a top side of said bottom block and supported on said rails, a supporting bar obliquely upwardly extended from said locating plate and a foot board fixedly mounted on said supporting bar;

a rear support, said rear support comprising a horizontal rear foot bar transversely disposed at a bottom side, two eyes fixedly provided at said horizontal rear foot bar near the two ends of said horizontal rear foot bar, a hollow upright sleeve vertically upwardly extended from a middle part of said horizontal rear foot bar, two lugs fixedly provided at two sides of said upright sleeve, a sliding bar slidably inserted into said upright sleeve, said sliding bar having a plurality of transversely extended locating holes arranged at different elevations and a top end pivotally connected between the rear ends of said rails, a grip fixedly connected to one end of said pivot, a lock pin fastened to the pin holes of said rails to lock said sliding bar to said rails, a spring pin provided at said upright sleeve and selectively engaged into one locating hole of said sliding bar to lock said sliding bar to said upright sleeve at the desired elevation, a locating plate fixedly fastened to the rear ends of said rails, and an adjustment knob mounted in the locating plate of said rear support and adapted to adjust the angular position of said rear support relative to said rails, said adjustment knob having a threaded shank threaded into the top end of said sliding bar;

two elastic pull cords, said elastic pull cords each having a first end terminating in a swivel hook for selectively coupling to the eyes at said horizontal front foot bar or the eyes at said horizontal rear foot bar, and a second end terminating in a handle, a tubular rocker arm, said rocker arm comprising a middle arm portion, said middle arm portion having a front side supported on said stop rod of said base frame, a front arm portion obliquely forwardly extended from top end of said middle arm portion, a rear arm portion obliquely backwardly extended from a bottom end of said middle portion, two connecting plates bilaterally pivotally fastened to said rear arm portion remote from said middle arm portion;

elastic cord members connected to the connecting plates at said tubular rocker arm and the lugs at said upright sleeve;

a handlebar, said handlebar comprising a vertically extended bottom mounting portion and two substantially transversely extended top hand grips, said vertically extended bottom mounting portion being inserted into the front arm portion of said rocker arm and having a plurality of locating holes longitudinally arranged in a row;

a spring pin provided at said front arm portion and selectively engaged into one locating hole of said handlebar to lock said handlebar to said rocker arm;

a slide, said slide comprising a substantially U-shaped base frame inserted in between said rails, top and bottom wheel axles provided at two sides of said base frame, top and bottom rollers respectively mounted on said wheel axles and peripherally disposed in contact with said rails at top and bottom sides, and two bottom lugs;

a plurality of elastic cord members connected between the bottom lugs of said base frame and the bottom lugs of said slide;

a seat, said seat comprising a seat frame fixedly fastened to the base of said slide; and a back, said back comprising a mounting frame pivotally connected to said seat frame of said seat by a pivot pin and locked by a lock pin being detachably fastened to the seat frame of said seat and the mounting frame of said back.

2. The rowing machine as claimed in claim 1, wherein the combined height of said vertical front bars and said horizontal front foot bar of said base frame is lower than the combined height of said horizontal rear foot bar and said hollow upright sleeve of said rear support.

3. The rowing machine as claimed in claim 1, wherein a buffer wheel is pivotally mounted in the U-shaped base frame of said slide and peripherally disposed in contact with a back side of said middle arm portion of said rocker arm.

* * * * *